US005241127A

United States Patent [19]

Kobayashi

[11] Patent Number: 5,241,127

[45] Date of Patent: Aug. 31, 1993

[54] MUSICAL TONE SYNTHESIZING APPARATUS

[75] Inventor: Kaoru Kobayashi, Owariasahi, Japan

[73] Assignee: Yamaha Corporation, Hamamatsu, Japan

[21] Appl. No.: 633,051

[22] Filed: Dec. 20, 1990

[30] Foreign Application Priority Data

Dec. 22, 1989 [JP] Japan ..... 1-334218
Jun. 1, 1990 [JP] Japan ..... 2-143736

[51] Int. Cl.[5] ..... G10H 1/02; G10H 5/02

[52] U.S. Cl. ..... 84/616; 84/624; 84/625; 84/659; 84/660; 84/661; 84/DIG. 9; 84/DIG. 10

[58] Field of Search ..... 84/604, 616, 615, 622, 84/624, 625, 659-661, DIG. 9, DIG. 10

[56] References Cited

U.S. PATENT DOCUMENTS 4,224,856 9/1980 Ando et al. ..... 84/615
4,893,538 1/1990 Masaki et al. ..... 84/605
4,957,032 9/1990 Hirano et al. ..... 84/622
4,984,276 1/1991 Smith ..... 381/63

FOREIGN PATENT DOCUMENTS 61-163390 7/1986 Japan .
63-40199 2/1988 Japan .

*Primary Examiner*—William M. Shoop, Jr.
*Assistant Examiner*—Brian Sircus
*Attorney, Agent, or Firm*—Graham & James

[57] ABSTRACT

The musical tone synthesizing apparatus simulating the musical tones of a natural musical instrument such as a piano. The apparatus contains a closed-loop circuit for simulating the vibration mechanism of the strings and a excitation circuit for generating excitation signals to the closed-loop circuit, so that the excitation circuit simulates the hammer striking the string. The apparatus also contains a scaling coefficient generating circuit for generating and supplying scaling coefficients to the excitation circuit, where the scaling coefficients represent the influence rate corresponding to the influence to be applied to the hammer by the string. In the excitation circuit, the excitation signals are multiplied by the scaling coefficients so that a slight difference of tone color is applied to the excitation signals with respect to tone pitch (or each key). For example, the scaling coefficient for comparatively lower tone pitch is set at a comparatively small value, because the hammer for lower tone pitch has relatively rounder shape and larger mass, and the felt thereof is formed relatively thicker, while the scaling coefficients for comparatively higher tone pitch is set at a comparatively large value. For this reason, the musical tone synthesizing apparatus generates a musical tone of which tone color is slightly different with respect to each tone pitch.

18 Claims, 4 Drawing Sheets

MUSICAL TONE SYNTHESIZING APPARATUS

BACKGROUND OF THE INVENTION

1. Field of the Invention

The present invention relates to a musical tone synthesizing apparatus which is suitable for simulating sounds of plucked string instruments, struck string instruments and the like.

2. Prior Art

Conventionally, apparatuses are known which synthesize musical tones of natural musical instruments by simulating their sound generation mechanisms. As for musical tone synthesizing apparatuses which synthesize the sounds of stringed instruments, there is the well-known apparatus which contains a closed-loop, including a low-pass filter for simulating reverberation-loss of strings and a delay circuit for simulating transmission delay of vibration of the strings. Alternatively, the apparatus may contain a multi-stage FIR filter (i.e., Finite Impulse Response digital filter) for simulating the string vibration. In the above-mentioned apparatus, when an excitation signal such as an impulse signal is supplied to and circulates in the closed-loop, the period in which the excitation signal circulates through the closed-loop once is set equal to the vibration period of the string. Furthermore, the frequency band-width of the excitation signal is limited when it is transmitted through the low-pass filter. Then, the signal circulating in the closed-loop is picked up as a musical tone signal.

Hence, in the above-mentioned musical tone synthesizing apparatus, by adjusting the delay time of the delay circuit and the characteristic of the low-pass filter, it is possible to generate musical tones which are approximately similar to the sounds of plucked string instruments such as the guitar or struck string instruments such as the piano. For example, the above-mentioned apparatus is disclosed in Japanese Patent Laid-Open Publication No. 63-40199 and Japanese Patent Publication No. 58-58679.

In acoustic instruments such as the piano, a hammer strikes a string so that the string vibrates at a pre-specified frequency. In this case, an acoustic instrument contains a predetermined number of keys, hammers and strings, wherein each pair consisting of a hammer and a string corresponds to each key. With respect to each key, the length and tension of the corresponding string and the inertia mass, the shape and solidity of the corresponding hammer are different from each other. For this reason, with respect to each key, there is a slightly different repulsion force which is applied to the hammer from the string when the hammer strikes the string. For example, a hammer corresponding to the key of relatively lower pitch has relatively rounder shape and larger mass, and the felt thereof at its striking point is formed relatively thicker and softer as shown in FIG. 12 (*a*). In contrast, a hammer corresponding to the key of relatively higher pitch has relatively sharper shape and smaller mass, and the felt thereof at its striking point is formed relatively thinner and more solid as shown in FIG. 12 (*b*). That is to say, in an acoustic instrument, each key has a different tone color depending on the repulsion force and the like applied to each hammer. For example, the sound of lower tone pitch has relatively softer tone color, while the sound of higher tone pitch has relatively harder tone color. However, according to the above-mentioned musical tone synthesizing apparatus, once data representative of the inertia mass and initial velocity of the hammer are inputted to the closedloop, such data settle the variation of the transition speed of the signal circulating in the closed-loop on a time axis. Hence, this apparatus cannot synthesize with high-fidelity acoustic musical tones the tone color of which is slightly different with respect to each key (or each tone pitch).

SUMMARY OF THE INVENTION

It is accordingly a primary object of the present invention to provide a musical tone synthesizing apparatus which can synthesize with high-fidelity acoustic musical tones the tone color of which is slightly different with respect to each tone pitch.

In a first aspect of the present invention, there is provided a musical tone synthesizing apparatus for simulating musical tones of a natural musical instrument including at least a sound vibrator which produces sound vibration to reciprocate through a sound-generation system of the natural musical instrument, the musical tone synthesizing apparatus comprising;

(a) closed-loop means through which an input signal is circulating while being delayed, wherein a delay time to be required when the input signal circulates through the closed-loop means once is set identical to a reciprocation period to be required when the sound vibration is transmitted forward and backward through the sound-generation system of the natural musical instrument once;

(b) excitation means for carrying out an operation by use of an operation parameter to thereby generate an excitation signal corresponding to the sound vibration in response to an operation of the sound vibrator, the excitation signal being supplied to the closed-loop means;

(c) tone pitch information generating means for generating tone pitch information; and (d) scaling coefficient generating means for generating a scaling coefficient based on the tone pitch information, the scaling coefficient being used to vary the operation parameter of the excitation means.

BRIEF DESCRIPTION OF THE DRAWINGS

Further objects and advantages of the present invention will be apparent from the following description, reference being made to the accompanying drawings wherein preferred embodiments of the present invention are clearly shown.

In the drawings.

DESCRIPTION OF THE PREFERRED EMBODIMENTS

Next, description will be given with respect to the preferred embodiments of the present invention.

A. FIRST EMBODIMENT

Figure 1:
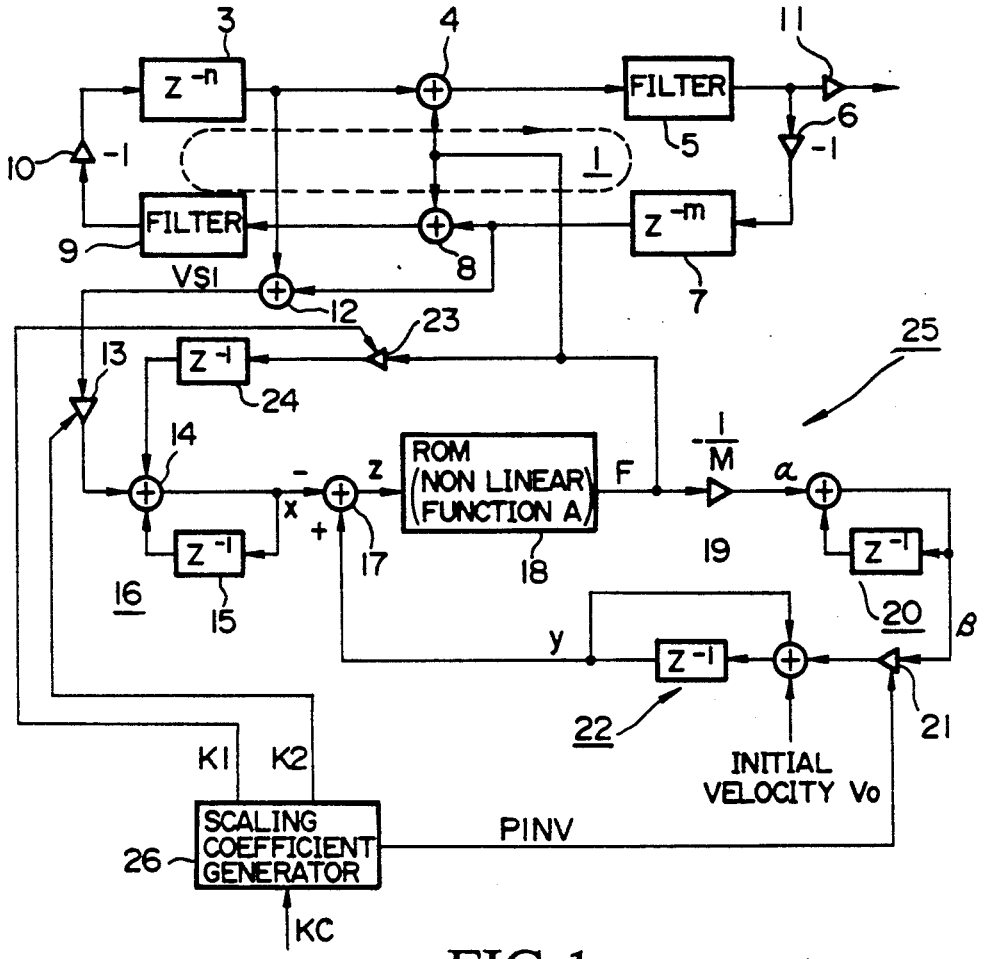
FIG. 1 is a block diagram showing an electric configuration of a musical tone synthesizing apparatus according to a first embodiment of the present invention.

FIG. 1 is a block diagram showing an electric configuration of a musical tone synthesizing apparatus according to a first embodiment of the present invention, which is designed to simulate a struck string instrument such as the piano. In FIG. 1, 1 designates a closed-loop circuit which contains a delay circuit 3, adders 4 and 8, filters 5 and 9, phase inverters 6 and 10, and a delay circuit 7. The closed-loop circuit 1 simulates the vibration mechanism of one string in the piano.

Figure 2:
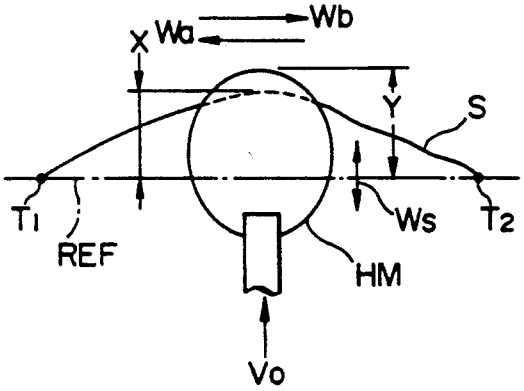
FIG. 2 is a conceptual diagram showing a mechanism for applying an excitation vibration to a string in a piano.

The details of the above-mentioned elements will be further described by referring to FIG. 2, showing a mechanism for applying the excitation vibration to the string in the piano. In FIG. 2, S, HM designate a string and a hammer which are provided corresponding to a key (not shown) in the piano. The string S is fixed at fixing terminals $T_1$ and $T_2$. In the case where the key of the piano is depressed, the corresponding string S is struck by the hammer HM, whereby a string vibration is caused in the string S. The vibration of the string S causes vibration waves $W_a$ and $W_b$ which are transmitted through the string S. Herein, the vibration wave $W_a$ is produced at the string struck point, transmitted through the string, reflected at the fixed terminal $T_1$ and then returned back to the string struck point, while another vibration wave $W_b$ is produced at the string struck point, transmitted through the string, reflected at the fixed terminal $T_2$ and then returned back to the string struck point. The closed-loop circuit 1 in FIG. 1 simulates the above-mentioned vibration of the string S. The delay circuits 3 and 7 have first and second delay times respectively. Herein, the first delay time corresponds to a period between the time when the vibration wave $W_a$ is produced at the string struck point and the time when $W_a$ is returned back to the string struck point, while the second delay time corresponds to a period between the time when the vibration wave $W_b$ is produced at the string struck point and another time when $W_b$ is returned back to the string struck point. The phase inverters 6 and 10 are provided corresponding to the fixing terminals $T_1$ and $T_2$ respectively, which simulate the phase inversion of the vibration waves $W_a$ and $W_b$ which occurs when the waves are reflected at the fixing terminals $T_1$ and $T_2$. Hence, the period of the signal circulating in the closed-loop circuit 1 once equals the vibration period of a standing wave $W_s$ which appears in the string S. Further, the signal being transmitted through the closed-loop circuit 1 is amplified by an amplifier 11 and then picked up as a musical tone signal having a tone pitch corresponding to the length of the string S. Herein, the filters 5 and 9 are designated to simulate the frequency characteristic of attenuation of the vibration in the string S. In other words, the filters 5 and 9 can accurately simulate the phenomenon in which the higher frequency components of the signal are attenuated rapidly in comparison with the lower frequency components.

Furthermore, an example of a musical tone synthesizing apparatus which is realized by a digital circuit is shown in FIG. 1. For example, delay circuits 3 and 7 contain multi-staged shift-registers respectively, in which each stage of the shift-resistors contains flip-flops, where the number of flip-flops in one stage is identical to the data width (i.e., number of bits) of the transmitting digital signal. Furthermore, a sampling clock signal is generated periodically by the predetermined period and then is supplied to the flip-flops. In this case, superscripts n and m showing in the blocks of delay circuits 3 and 7 in FIG. 1 respectively designate numbers of the stages of the shift resistors corresponding to the delay circuits 3 and 7 respectively. Similar to the above-mentioned delay circuits 3 and 7, other components in FIG. 1 are also realized by digital circuits.

Hereinafter, description will be made to more detail of the musical tone synthesizing apparatus shown in FIG. 1. The output signals of the delay circuits 3 and 7 (i.e., excitation signals) are supplied to an excitation circuit 25. The excitation circuit 25 contains an adder 12, multipliers 13, 19, 21, 23, integral circuits 16, 20, 22, a substractor 17, a ROM 18 and a one-sampling period delay circuit 24. The above-mentioned excitation signals are added together by the adder 12, whereby an addition result is outputted as a velocity signal $V_{S1}$ which represents the vibration velocity of the string S. The velocity signal $V_{S1}$ is multiplied by a scaling coefficient K2 in the multiplier 13. The details of the coefficient K2 will be described later.

Then, the output signal of the multiplier 13 is supplied to the adder 14. On the other hand, a signal F representative of the repulsion force applied to the hammer HM is supplied to the adder 14 via the multiplier 23 and one-sampling-period delay circuit 24. Further, a scaling coefficient K1 is also supplied to the multiplier 23. The output signal from the adder 13 and the signal F are integrated by the integral circuit 16 which consists of the adder 14 and one-sampling-period delay circuit 15, whereby an integral result is generated from the integral circuit 16. The integral result represents the displacement X formed between a stationary line REF and string S as shown in FIG. 2. The integral result (hereinafter, referred to as a string displacement signal x) is supplied to the negative input terminal of the subtractor 17. On the other hand, the output signal of the integral circuit 22 is supplied to the positive input terminal of the subtractor 17. This output signal (hereinafter, referred to as a hammer displacement signal y) represents the displacement Y formed between the stationary line REF and hammer HM as shown in FIG. 2. The details of the operation of the integral circuit 22 will be described later. Hence, the subtractor 17 outputs a subtraction signal z (where, $z=y-x$) to the ROM 18, where the signal z represents the disparity of the displacements X and Y (i.e., $Y-X$). In the case where the string S is partially dug into the hammer HM, the subtraction signal z has a positive value, so that the repulsion force has a value corresponding to the disparity Y−X. In short, the signal F corresponding to the repulsion force is directly set at the pre-specified value. On the other hand, in the case where the string S touches the hammer HM softly or it is released from the hammer HM, the subtraction signal z is at a zero level or a negative level, so that the repulsion force (i.e., signal F) is set at a zero level.

Figure 3:
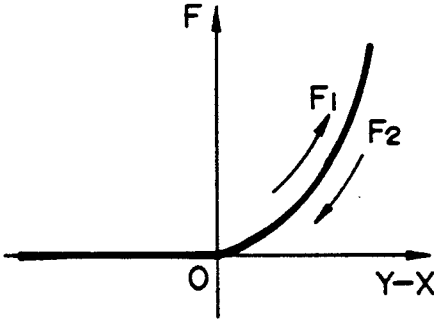
FIG. 3 is a graph showing an example of a non-linear function used in the first embodiment of the present invention.

Herein, a non-linear table is set in the above-mentioned ROM 18; this table stores data representative of a non-linear function A. This non-linear function A represents the relationship between the disparity Y−X and repulsion force F, wherein the disparity Y−X represents the relative displacement between the string S and the hammer HM, while the repulsion force F represents the repulsion force imparted between the string S and the hammer HM. FIG. 3 shows an example of the non-linear function A in the case where the hammer HM is made of soft materials such as felt and the like. As shown in FIG. 3, in the case where the disparity Y−X is at a zero or negative value (i.e., the string S is not struck by the hammer HM), the repulsion force F is at zero level. On the other hand, in the case where the string S is struck by the hammer HM, the repulsion force F increases gradually as the disparity Y−X increases. Incidentally, in the case where the hammer HM is made of hard materials, the non-linear function A is set such that the repulsion force F increases more sharp by than the case where the hammer is made of soft materials.

Thus, the ROM 18 outputs the signal F representing the repulsion force F in accordance with the disparity Y−X at an arbitrary time. Then, the signal F is supplied to the multiplier 19 and adders 4 and 8 in the closed-circuit 1. The signal F supplied to the adders 4 and 8 is added to a signal representing the standing wave $W_s$ which is circulating in the closed-circuit 1.

On the other hand, the multiplier 19 multiplies the signal F by a multiplication coefficient −1/M, where M is a coefficient representing the inertia mass of the hammer HM. Hence, the multiplier 19 outputs an acceleration signal $\alpha$ to the integral circuit 20, where the signal $\alpha$ represents the acceleration of the hammer HM. The integral circuit 20, which consists of an adder and a one-sampling-period delay circuit similar to the integral circuit 16, integrates the acceleration signal $\alpha$ and then outputs the integral result thereof to the multiplier 21 as a signal $\beta$ which represents the velocity variation amount of the hammer HM. The multiplier 21 also receives a scaling coefficient PINV, wherein the signal $\beta$ is multiplied by the coefficient PINV and then its multiplication result is supplied to the integral circuit 22. The integral circuit 22 adds an initial velocity signal $V_0$ representing the initial velocity of the hammer HM and the signal $\beta$ together and then integrates the result of this addition, whereby an integral result is supplied to the subtractor 17 as the displacement signal y which represents the displacement Y of the hammer HM.

Furthermore, 26 designates a scaling coefficient generator which generates the scaling coefficients K1, K2 and PINV in accordance with key code KC which is generated by a manual operation portion such as a keyboard and the like (not shown). The scaling coefficients K1, K2 and PINV are computed depending on the key code KC in order to simulate the slight difference of repulsion force F which occurs depending on the differences of the lengths, tensions of the strings S, inertia masses of the hammers HM and the like corresponding to the keys respectively. More specifically, the scaling coefficient K1 represents the force applied to the string S from the hammer HM. In other words, the coefficient K1 is a parameter indicating an influence rate representative of the influence to be applied to the hammer HM due to the tension of the string S, wherein this parameter is used to compute the displacement X in accordance with the output signal of ROM 18. Similar to the foregoing scaling coefficient K1, another scaling coefficient K2 is a parameter indicating the influence rate representative of the influence applied to the hammer HM due to the tension of the string S.

Furthermore, the scaling coefficient PINV is a parameter indicating the influence rate representative of the influence applied to the hammer HM due to the repulsion force of the string S. The scaling coefficients K1, K2 and PINV are supplied to the excitation circuit 25 in order to change the tone color and also prevent the overflow phenomenon of the digital circuits. The scaling coefficient generator 26 computes the scaling coefficients K1, K2 and PINV in accordance with the key code KC. Or, this generator 26 can be designed as a data table from which the coefficients K1, K2 and PINV are read out in accordance with the key code KC.

Hereinafter, description will be made of the operation of the first embodiment.

First of all, the pre-specified delay time corresponding to the key code KC is set for each of the delay circuits 3, 7. Further, the output levels of the one-sampling-period delay circuits which are contained in the integral circuits 16, 20, 22 are all reset at a zero level. Then, a musical tone generation control circuit (not shown) generates the initial velocity signal $V_0$. The scaling coefficient generator 26 generates the coefficients K1, K2 and PINV in accordance with the key code KC. The integral circuit 22 integrates the initial velocity signal $V_0$, whereby the hammer displacement signal y is generated and supplied to the subtractor 17. In this case, while the hammer displacement signal y increases from a certain negative value in a positive direction over a period of time, the string displacement signal x remains at "0". Hence, the subtraction signal z is set at a negative value, and the signal F remains at "0" in this term as shown in FIG. 3. Therefore, the output signal $\beta$ of the integral circuit 20 also remains at "0", and the integral circuit 22 carries out the integration only for the initial velocity signal $V_0$, so that the hammer displacement signal y increases from a certain negative value in a positive direction (see arrow $F_1$ in FIG. 3, which indicates that the hammer HM is moving toward the stationary string S).

Then, in the case where the subtraction signal z goes over "0", whereby the signal z has a positive value (which simulates the striking of the string S by the hammer HM), a signal F representing the repulsion force corresponding to the subtraction signal z is outputted from the ROM 18. Then, the signal F is supplied to the multiplier 19 and the closed-loop circuit 1.

Then, the signal F is multiplied by the coefficient −1/M in the multiplier 19, whereby the multiplication result is outputted as the acceleration signal $\alpha$ (having a negative value). Furthermore, the acceleration signal $\alpha$ is integrated in the integral circuit 20, whereby the integration result is outputted as the signal $\beta$ which represents the velocity variation. Then, the signal $\beta$ is multiplied by the coefficient PINV in the multiplier 22. In this case, the signal $\beta$ has a negative value. Therefore, the integration is carried out on the result of the subtraction of the initial velocity signal $V_0$ and signal $\beta$ (i.e., $V_0-\beta$), then the integration result is supplied to the subtractor 17 as a new hammer displacement signal y.

On the other hand, in the closed-loop circuit 1, the hammer displacement signal y is added to the signals circulating in the loop, whereby the addition results circulate in the loop once as the excitation signals. Then, the excitation signals which have circulated in the loop once are outputted from the delay circuits 3 and 7 respectively, added in the adder 12, and supplied to the multiplier 13 as the velocity signal $V_{s1}$. The velocity signal $V_{s1}$ is multiplied by the scaling coefficient K2 and then supplied to the adder 14 in the integral circuit 16. The adder 14 also receives the signal F which is multiplied by the scaling coefficient K1, whereby addition is carried out on the output signal of the multiplier 13 and the signal F, then the result of the addition is integrated. The integration result is supplied to the subtractor 17 as a new string displacement signal x. Further, the excitation signal circulating in the closed-loop circuit 1 is outputted via the multiplier 11 as a musical tone signal.

Then, the subtractor 17 in the excitation circuit 25 subtracts the new string displacement signal x from the hammer displacement signal y, whereby the subtraction signal z is calculated. Hence, the ROM 18 outputs a new signal F according to the subtraction signal z.

Hereinafter, the above-mentioned operation is continued until the signal $\beta$ exceeds the initial velocity signal $V_0$. For this reason, the absolute values of the acceleration signal $\alpha$ and signal $\beta$ increase in a negative direction as the subtraction signal z increases. Hence, the rate of increase of the hammer displacement signal y is gradually decreased.

Herein, when the signal $\beta$ exceeds the initial velocity signal $V_0$, the moving direction of the hammer HM is changed inversely to a direction such that the hammer HM is departing from the string S. Therefore, in this case where the signal $\beta$ exceeds the initial velocity signal $V_0$, the hammer displacement signal y changes in a negative direction. As a result of the change, the subtraction signal z gradually decreases, whereby the signal F also gradually decreases (see arrow $F_2$ in FIG. 3). Hence, the excitation signal which circulates in the closed-loop circuit 1 also gradually decreases. Then, in the case where the subtraction signal z becomes smaller than "0", the hammer HM is departing from the string S, whereby the hammer HM is released from the effect due to the elastic characteristics of the string S. In this case, the above-mentioned string striking operation is finished.

Then, in the case where another key code KC is supplied to the scaling coefficient generating circuit 26, the circuit 26 generates another set of the scaling coefficients K1, K2 and PINV (which set is different from the preceding set) according to another key code KC. Thereafter, an operation similar to the forgoing string striking operation is carried out.

Thus, according to this embodiment, the musical tone to be generated has a tone color which can be slightly varied in accordance with the initial velocity of hammer HM and the key code KC.

In the embodiment described heretofore, the ROM 18 in which the non-linear function A is stored is employed to generate the signal F in accordance with the subtraction signal z. However, it is possible to compute signal F in accordance with the subtraction signal z.

Further, in contrast to the embodiment in which a musical tone synthesizing apparatus is embodied by digital circuits, it is possible to embody this apparatus by analog circuits the operations of which are similar to those of the digital circuits.

Further, delay operations and calculations which are carried out in the digital circuits in the embodiment may be realized by a computer or a DSP (i.e., digital signal processor).

Furthermore, wave-guides which are disclosed in Japanese Patent Laid-Open No. 63-40199 and the like can be applied to the closed-loop circuit which contains delay circuits.

B. SECOND EMBODIMENT

Figure 4:
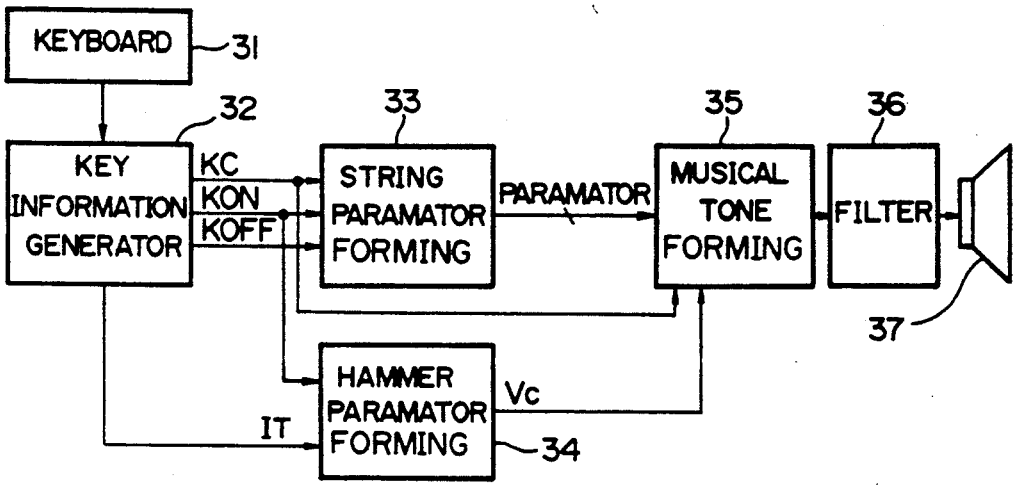
FIG. 4 is a block diagram showing an electric configuration of a musical tone synthesizing apparatus according to a second embodiment of the present invention.

FIG. 4 is a block diagram showing an electric configuration of a musical tone synthesizing apparatus according to the second embodiment of the present invention. In FIG. 4, 31 designates a keyboard, and 32 designates a key information generator. When the key is depressed, the key code information KC, key-on signal KON which indicates that the key is being depressed, and initial touch information IT which indicates an initial key depression force of the key are generated by the key information generator 32. Then, in the case where the key is released, a key-off signal KOFF is generated.

Figure 5:
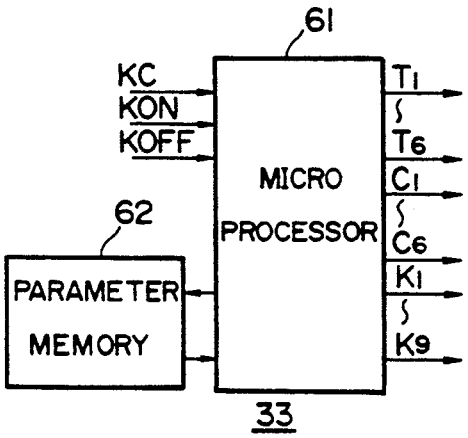
FIG. 5 is a block diagram showing an electric configuration of a string parameter forming circuit 33 shown in FIG. 4.

33 designates a string parameter forming circuit, containing a micro processor 61 and a parameter memory 62 which is embodied by ROM (i.e. read-only memory) as shown in FIG. 5. Upon receipt of the key code information KC, the key-on signal KON and the key-off signal KOFF, the micro processor 61 generates delay information $T_1$ to $T_6$ which correspond to the key-code information KC, and further generates filter operation coefficients $C_1$ to $C_6$ and multiplication coefficients $k_1$ to $k_9$. Among above mentioned coefficients and information, data representative of the delay information $T_1$ to $T_6$ and the filter operation coefficients $C_1$ to $C_6$ are stored in respective divisions contained in the parameter memory 62. Therefore, when the key-on signal KON is asserted, coefficients and information corresponding to the key-code KC are read from the parameter memory 62 by the micro processor 61. Further details of the information $T_1$ to $T_6$ and coefficients $C_1$ to $C_6$ and $k_1$ to $k_9$ will be described later.

Figure 7:
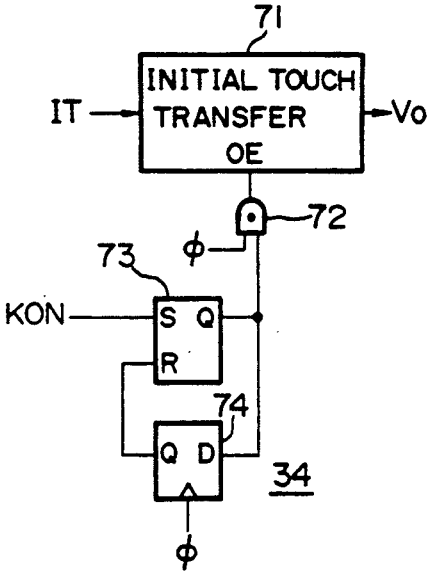
FIG. 7 is a block diagram showing an electric configuration of a hammer parameter forming circuit 34 shown in FIG. 4.
Figure 6:
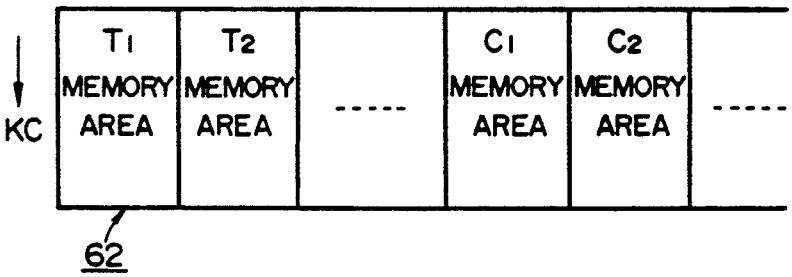
FIG. 6 is a memory map of a parameter memory 62 shown in FIG. 5.

34 designates a hammer parameter forming circuit, and the composition thereof is shown in FIG. 7. In FIG. 7, 73 designates a flip-flop which is set by the key-on signal KON. An output Q of the flip-flop 73 is latched by a delayed type flip-flop 74 in synchronism with a clock signal $\phi$ to be generated by the predetermined period. Further, the flip-flop 73 is reset by the output Q of the flip-flop 74. Upon receipt of the clock signal $\phi$ and the output Q of the flip-flop 73, an output signal of an AND gate 72 is supplied to a ROM 71 as an output enable signal OE. The ROM 11 stores information which indicates hammer velocity corresponding to the initial touch information IT.

Hence, according to the hammer parameter forming circuit 34, after the key-on signal KON is asserted, the ROM 71 is set in the enable state during one period of the clock signal $\phi$, so that an initial hammer velocity signal $V_0$ corresponding to the initial touch information IT is read from the ROM 71.

Figure 8:
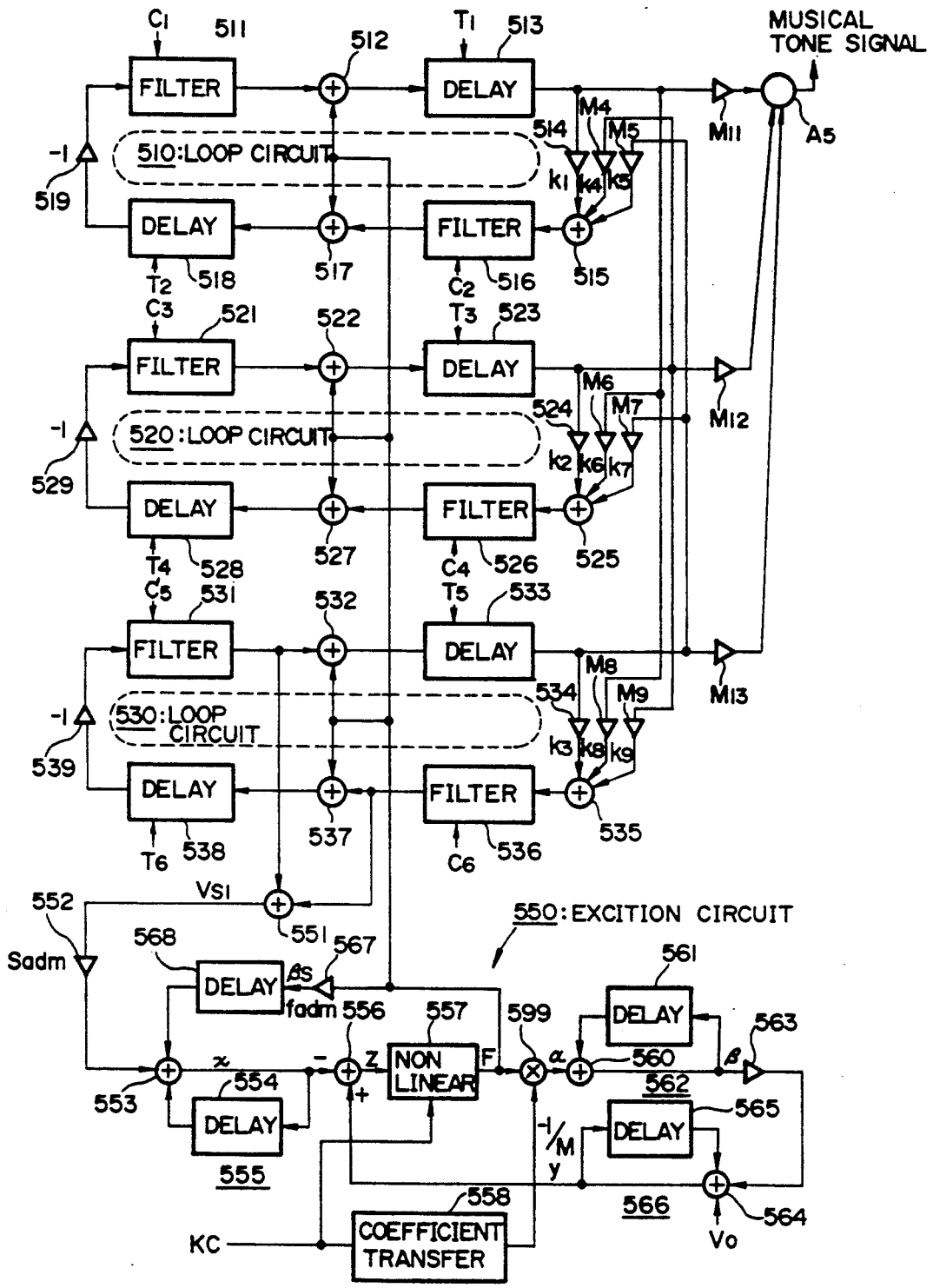
FIG. 8 is a block diagram showing an electric configuration of a musical tone forming circuit 35 shown in FIG. 4.

Further, 35 designates a musical tone forming circuit, and the composition thereof is shown in FIG. 8. The circuit 35 is designed to form a musical tone signal of a three string type piano which provides three strings to be struck by the hammer by each pitch. In FIG. 8, 510 designates a loop-circuit which contains filters 511, 516, adders 512, 515, 517, delay circuits 513 & 518, a multiplier 514 and a phase inverter 519. Further, 520 and 530 designate loop-circuits each of which is composed as similar to the loop-circuit 510. Then, the loop-circuits 510, 520 and 530 are designed to simulate the reciprocate transmission of vibration waves in the strings.

The delay circuits 513 and 518 are variable delay circuits for simulating transmission delay of vibration on a first string, where the delay time thereof is settled according to the delay information $T_1$ and $T_2$. Similar to the delay circuits 513 and 518, delay information $T_3$ and $T_4$ are supplied to delay circuits 523 and 528, delay information $T_5$ and $T_6$ are supplied to delay circuits 533 and 538. For example, above-mentioned delay circuits may be embodied by a multi-staged shift-register and a selector, where an input signal is delayed by the shift-register. Herein, the selector selects one of the delayed signals from the plural stages in the shift-register in accordance with the delay information.

In the view of the acoustic piano, tension forces respectively applied to the three strings are usually not the same, whereby the so-called detune effect is caused on the musical tone. Hence, with consideration of the detune effect in the acoustic piano, each of the total delay times of the loop-circuits 510, 520, 530 is set at the value approximately corresponding to the tone pitch thereof. In addition, the delay information $T_1$ to $T_6$ will be set such that the total delay times of the loop-circuits 510, 520, 530 are subtle different from each other.

Each of three pairs of filters 511 & 516, 521 & 526 and 531 & 536 is provided to simulate the acoustic loss of each of the three strings. Generally, as the frequency of the musical tone becomes higher, the acoustic loss becomes larger. Hence, the filters can be embodied by low-pass filters. Each of three pairs of the filters 511 & 516, 521 & 526 and 531 & 536 receives the filter operation coefficients $C_1$ & $C_2$, $C_3$ & $C_4$ and $C_5$ & $C_6$ respectively, whereby filter operations corresponding to the key code KC will be carried out in accordance with the coefficients $C_1$ to $C_6$.

Each of three pairs of the phase inverter 519 & multiplier 514, phase inverter 529 & multiplier 524 and phase inverter 539 & multiplier 534 is provided to simulate phase inverting phenomenon of the corresponding string, wherein this phenomenon is caused at both ends of each string when the vibration wave is reflected at both ends. In the case where the musical tone is generated, the multipliers 514, 524 and 534 receive negative-valued coefficients $k_1$, $k_2$ and $k_3$ respectively from the string parameter forming circuit 33. Further, in the case where the key-off signal KOFF is generated, the absolute values of the multiplication coefficients $k_1$, $k_2$ and $k_3$ are reduced by the parameter forming circuit 33, so that the musical tone will be rapidly attenuated.

An output signal of the delay circuit 513 in the loop circuit 510 is multiplied by the coefficient $k_6$ at a multiplier $M_6$, and then the multiplication result is supplied to the loop circuit 520 via an adder 525. On the other hand, the output signal of the delay circuit 513 is multiplied by the coefficient $k_8$ at a multiplier $M_8$, and then the multiplication result is supplied to the loop circuit 530 via an adder 535. Similarly, an output signal of the delay circuit 523 in the loop circuit 520 is multiplied by the coefficient $k_4$ at a multiplier $M_4$ and then the multiplication result is supplied to the loop circuit 510 via an adder 515, while the output signal of the delay circuit 523 is multiplied by the coefficient $k_9$ at a multiplier $M_9$ and then the multiplication result is supplied to the loop circuit 530 via the adder 535. Further, an output signal of the delay circuit 533 in the loop circuit 530 is multiplied by the coefficient $k_5$ at a multiplier $M_5$ and then the multiplication result is supplied to the loop circuit 510 via the adder 515, while the output signal of the delay circuit 533 is multiplied by the coefficient $k_7$ at a multiplier $M_7$ and then the multiplication result is supplied to the loop circuit 520 via the adder 525. According to above-mentioned composition, bi-directional signal transmission is taken over between the loop circuits 510, 520 and 530, whereby bi-directional interference between the three strings is to be simulated. Hence, the values of the coefficients $k_4$ to $k_9$ will be set according to the bi-directional interference taken over between the three strings to be simulated.

Hereinafter, description will be made to an excitation circuit 550 in FIG. 8. The excitation circuit 550 generates an excitation signal which represents an excitation vibration to be applied to the strings by the hammer. Output signals of the filters 531 & 536 in the loop circuit 530 are supplied to an adder 551, which generates an string velocity signal $V_{s1}$ representing the vibration velocity of the string. The string velocity signal $V_{s1}$ is multiplied by an coefficient sadm at a multiplier 552. The details of the coefficient sadm will be described later.

The output signal sadm.$V_{s1}$ of the multiplier 552 is then integrated by an integral circuit 555 which contains an adder 553 and an one-sampling period delay circuit 554. Hence, as similar to the first embodiment, the integral circuit 555 generates string displacement signal x which represents the displacement formed between a stationary line REF and string SP as shown in FIG. 2. The string displacement signal x is supplied to the a positive input terminal of the subtractor 556. On the other hand, the output signal of an integral circuit 566 is supplied to a negative input terminal of the subtractor 556. The output signal of the integral circuit 556 (hereinafter, referred to as a hammer displacement signal y) represents the displacement formed between the stationary line REF and hammer HM as shown in FIG. 2. Then, the subtractor 556 outputs a subtraction signal z ($z=y-x$) which represents the displacement formed between the hammer HM and the string SP.

In the case where the string SP is partially dug into the hammer HM, the subtraction signal z has a positive value, so that the repulsion force between the string SP and the hammer HM has a value corresponding to their displacement. On the other hand, in the case where the string SP touches the hammer HM softly or it is released from the hammer HM, the subtraction signal z is at "0" or a negative level, so that the repulsion force is set at "0"-level.

Figure 9:
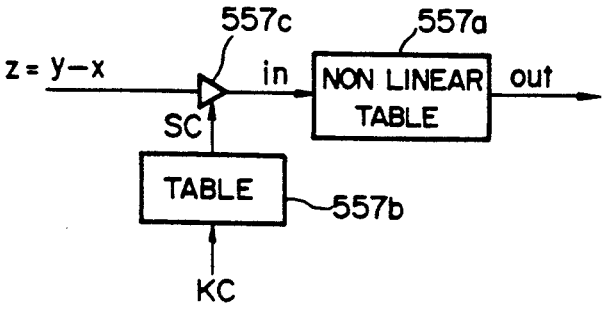
FIG. 9 is a block diagram showing an electric configuration of a non-linear circuit 557 shown in FIG. 8.
Figure 10:
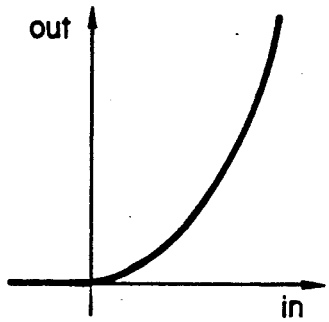
FIG. 10 is a graph showing an example of a characteristic of a non-linear table shown in FIG. 9.
Figure 11:
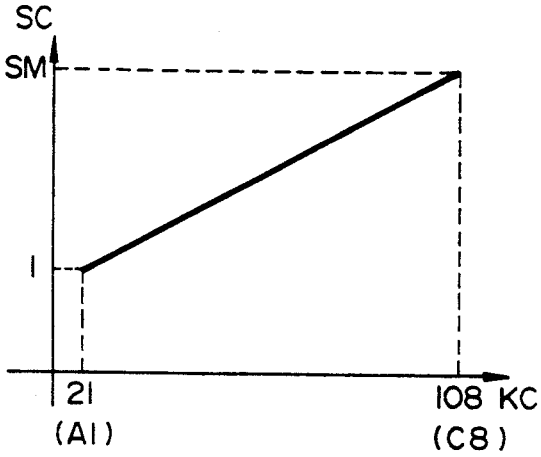
FIG. 11 is a graph showing an example of a characteristic of a key scaling coefficient SC used in the second embodiment of the present invention.
Figure 12:
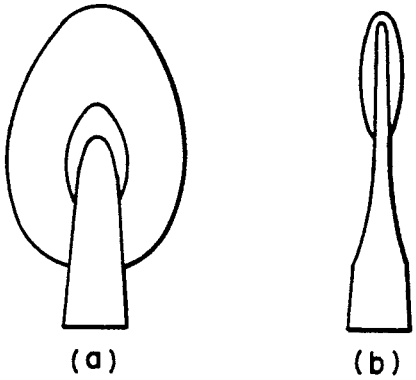
FIGS. 12(*a*), (*b*) are views illustrating examples of hammers used in an acoustic piano.

A non-linear circuit 557 outputs a repulsion force signal F which represents the repulsion force applied between the string SP and the hammer HM in accordance with the key code information KC and the subtraction signal z. The circuit 557 contains ROMs 557*a* and 557*b* as shown in FIG. 9. The ROM 557*a* stores a non-linear function table which contents indicates like a quadratic curve as shown in FIG. 10, for example. On the other hand, the ROM 557*b* stores a table of key scaling coefficients SC, wherein a coefficient SC corresponding to the key code KC is to be read out and supplied to a multiplier 557c as a multiplication coefficient. More specifically, as shown in FIG. 11, the key scaling coefficients SC are set such that the values thereof are linearly increasing according to the key code KC. For example, in the case where the key code KC equals "21" (this key code corresponds to a lowest tone pitch "A1"), the coefficient SC is set at "1". On the other hand, in the case where the KC equals "108" (this key code corresponds to a highest tone pitch "C8"), the scaling coefficient SC is set to SM (where SM is the predetermined maximum value). The multiplier 557c multiplies the subtraction signal z by the key scaling coefficient SC, then the multiplication result is supplied to the ROM 557a as address information, whereby the repulsion force signal F is read from the ROM 557a.

Figure 13:
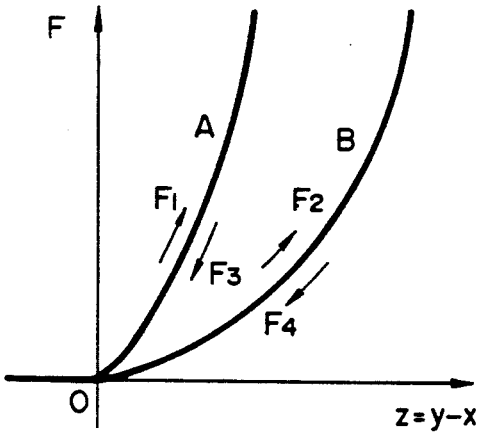
FIG. 13 is a graph showing the repulsion force applied to the hammer from the string.

Accordingly, in the case where the key code information KC is set to the comparatively small value, the non-linear circuit 557 generates the repulsion force signal F in the manner that the signal F gradually varies according to the subtraction signal z as shown by a curved line B in FIG. 13. In contrast, in the case where the key code information KC is set to the comparatively large value, the non-linear circuit 557 generates the repulsion force signal F in the manner that the signal F sharply varies according to the subtraction signal z as shown by a curved line A in FIG. 13.

The repulsion force signal F is supplied to all of the adders 512 & 517 in the loop-circuit 510, the adders 522 & 527 in the loop-circuit 520 and the adders 532 & 537 in the loop-circuit 530. Normally, the signal F shall be multiplied by a coefficient representing the physical resistance of the string SP which affects the vibration velocity of the string SP, and then the multiplication result representing the variation of the vibration velocity of the string S shall be divided by "2", and then the divided multiplication result is supplied to the loop-circuits 510, 520 and 530 respectively. However, according to the present embodiment, above-mentioned multiplication coefficient sadm is to be adjusted under consideration of the above-mentioned physical resistance of the string SP, etc.

Further, the repulsion force signal F is multiplied by the coefficient fadm, whereby a string velocity signal $\beta_s$ which represents the variation of the vibration velocity of the string SP due to the hammer HM. The velocity signal $\beta_s$ is delayed one-sampling period in a delay circuit 568, and then the delayed velocity signal is supplied to the integral circuit 555. Accordingly, certain phenomenon is simulated such that the state of the string SP is varied when being struck by the hammer HM.

Further, the repulsion force signal F is supplied to a multiplier 559. On the other hand, when receiving the key code KC, a coefficient transfer circuit 558 outputs the corresponding coefficient "$-1/M$" to the multiplier 559, wherein "M" represents the inertial mass of the hammer corresponding to the key code KC. As a result, the multiplier 559 outputs a hammer acceleration signal $\alpha$ which represents the acceleration of the hammer HM. The hammer acceleration signal $\alpha$ is integrated by an integral circuit 562 which contains an adder 560 and a delay circuit 563, whereby the integral circuit 562 outputs a hammer velocity signal $\beta$ which represents the velocity variation of the hammer HM. Then, the hammer velocity signal $\beta$ is multiplied by the predetermined attenuation coefficient at a multiplier 563, and then the multiplication result is supplied to an adder 564 where the output signal of the multiplier 563 is added to the initial hammer velocity signal $V_0$ which is outputted by the hammer parameter forming circuit 34 (see FIG. 4). Then, the addition result is integrated by an integral circuit 566 which contains the adder 564 and a delay circuit 564. Hence, the integral circuit 566 outputs the above-mentioned hammer displacement signal y.

The output signals of the delay circuits 513, 523 & 533 in the corresponding loop-circuits are multiplied by the predetermined coefficients respectively at multipliers $M_{11}$, $M_{12}$ & $M_{13}$. The output signals of the multipliers are added together at an adder $A_5$, then the addition result thereof is outputted as a musical tone signal via the filter 36 (see FIG. 4) which simulates a sound board in the acoustic piano, whereby resonance effect is imparted to the musical tone signal. Then, the digital musical tone signal is converted into an analog signal by an A/D converter (analog/digital converter, not shown), so that a speaker 37 generates the corresponding musical tone.

Hereinafter, description will be made to the operation of the second embodiment.

In an initial condition before the hammer strikes the string, the hammer HM is positioned apart from the string. Accordingly, in the musical tone forming circuit 35, the subtraction signal z is set at a negative value, hence, the repulsion force signal F is also set at "0".

In the case where the key in the keyboard 31 is depressed, the key information generator 32 generates the key code KC, key-on signal KON and initial touch information IT each corresponding to the depressed key. Hence, the string parameter forming circuit 33 generates the delay information $T_1$ to $T_6$ and filter operation coefficients $C_1$ to $C_6$ respectively corresponding to the key code KC. Then, these information and coefficients are set to the corresponding parts in the musical tone forming circuit 35. Further, initial hammer velocity is calculated by the hammer parameter forming circuit 34 according to the initial touch information IT, then the initial hammer velocity signal $V_0$ is supplied to the integral circuit 566 during one period of the clock signal $\phi$.

As a result, the integration result of the integration circuit 566 (i.e., the hammer displacement signal y) is increased from the negative value to the positive value in a lapse of time. In this interval, the string displacement signal x is set at "0", so that the subtraction signal $y-x$ has a negative value, representing the condition where the hammer HM is apart from the string SP. Hence, since the repulsion force signal F is set at "0" as shown in FIG. 13, the hammer velocity signal $\beta$ is also set at "0". Accordingly, the integration circuit 566 only integrates the initial hammer velocity signal $V_0$.

Then, in the case where the subtraction signal $y-x$ goes over "0" and set to the positive value, representing the condition where the hammer HM is just struck to the string SP, the non-linear circuit 557 generates the repulsion force signal F, which value is set according to the key code KC and subtraction signal $y-x$. Then, the repulsion force signal F is multiplied in the multiplier 559 by the coefficient $-1/M$ according to the key code KC, then, the multiplication result is outputted as the hammer acceleration signal $\alpha$. Then, the integration circuit 562 integrates the acceleration signal $\alpha$, whereby the hammer velocity signal $\beta$ is outputted. At this time, the hammer velocity signal $\beta$ is set to the negative value, wherein the integration circuit 566 integrates the difference between the initial velocity signal $V_0$ and hammer velocity signal $\beta$, so that the inclination of the hammer displacement signal y becomes small in a lapse of time. Further, the string velocity signal $\beta_s$ is generated according to the hammer repulsion force signal F, and then it is integrated in the integral circuit 555, so that the string displacement signal x is varied.

In this interval, the hammer displacement signal y increases in the positive direction in which the hammer HM is moved and then deeply dug into the string SP, so that the subtraction signal z increases. As a result, the repulsion force signal F increases. In the case where the key code information KC has relatively large value (i.e. high pitch), the repulsion force signal F rapidly increases as shown by an arrow $F_1$ in FIG. 13. In contrast, in the case where the key code information KC has relatively small value (i.e. low pitch), the repulsion force signal F slowly increases as shown by an arrow $F_2$ in FIG. 13.

As a result of the generation of the acceleration signal $\alpha$ to be generated according to such generated repulsion force signal F, the hammer velocity signal $\beta$ increases in the negative direction in which the hammer HM is moved apart from the string SP. Then, in the case where the absolute value of the hammer velocity signal $\beta$ goes over the initial hammer velocity signal $V_0$, the hammer displacement signal y is varied in the negative direction. Then, the subtraction signal z gradually decreases as time goes, therewith the repulsion force signal F decreases. In the case where the key code information KC has relatively large value, the repulsion force signal F rapidly decreases as shown by an arrow $F_3$ in FIG. 13. In contrast, in the case where the key code information KC has relatively small value, the repulsion force signal F slowly decreases as shown by an arrow $F_4$ in FIG. 13. Then, when the subtraction signal z becomes smaller than "0", that is to say, the hammer HM is apart from the string SP, the striking operation is finished.

As described heretofore, the repulsion force signal F in the striking operation is to be generated, and then supplied to the loop-circuits 510, 520 & 530 as the excitation signal corresponding to the variation of the vibration velocity of the string SP to be applied by the hammer HM. Then, the supplied excitation signal circulates the loop-circuits 510, 520 & 530 respectively. Further, the circulating signal in the loop-circuit 510 is supplied to the loop-circuits 520 & 530 via the multiplier $M_6$ & $M_8$ respectively. Similarly, signal transmissions from the loop-circuit 520 to the loop-circuits 510 & 530 and from the loop-circuit 530 to the loop-circuits 510 & 520 are carried out. Accordingly, the interference between the three strings in the acoustic piano is to be simulated.

Then, output signals of the loop-circuits 510, 520 and 530 are supplied to the adder $A_5$ via the multipliers $M_{11}$, $M_{12}$ and $M_{13}$ respectively, and then they are added together by the adder $A_5$. As a result, the musical tone signal is outputted from the adder $A_5$, transmitted through the filter 36 whereby the resonance effect is imparted to the musical tone signal, which musical tone is generated from the speaker 37.

Incidentally, although the musical tone synthesizing apparatus of the second embodiment is embodied by use of the digital circuits, it is needless to say that the apparatus may be embodied by use of the analog circuits as described in the first embodiment. Further, the loop-circuits which contain the delay circuits may be embodied by the conventional wave-guide as described in the first embodiment. Furthermore, according to the second embodiment, the non-linear table, etc. which simulate the inertia mass M of the hammer and the elasticity characteristic of the felt are selectively used according to the key code KC. It is not limited to set the parameters according to the actual construction of the acoustic instrument, however, the performer can set the various parameters as he pleases in order to freely create the sounds.

Further, when plural sets of the hammer parameters may be provided corresponding to one key code, thereby the performer can select any set of the parameters as he pleases by means of a sound select switch and the like. Further, it is not limited to provide the non-linear table in order to embody the elasticity characteristic of the felt, therefore, it is possible to embody such characteristic by an operation circuit and the like. Further, according to the second embodiment, the key scaling coefficient SC is linearly varied according to the key code KC, however, it is possible to measure the elasticity characteristic of the felt corresponding to each key in the acoustic piano, then the key scaling coefficients may be set according to the measurement result. Alternatively, the key scaling coefficients may be set by the performer as he pleases in order to freely create the sounds. Further, delay circuits in the musical tone forming circuit may either embodied by RAMs (i.e., random-access memories) or analog delay circuits. Furthermore, the second embodiment may either be embodied by the hardware circuit or software. Though the musical tone synthesizing apparatus according to the present invention is suitable for simulating sounds of the plucked string instruments and struck string instruments, the advantages of the invention are not limited to the above-mentioned simulation. That is to say, by varying the non-linear function and the various coefficient, the apparatus can generate various sounds which cannot be generated by the natural musical instruments at all.

As described heretofore, this invention may be practiced or embodied in still other ways without departing from the spirit or essential character thereof. Therefore, the preferred embodiments described herein is illustrative and not restrictive, the scope of the invention being indicated by the appended claims, and all variations which come within the meaning of the claims are intended to be embraced therein.

What is claimed is:

1. A musical tone synthesizing apparatus for simulating a sound generating system including at least one sound vibrator which produces sound vibration to reciprocate through the sound-generation system, said musical tone synthesizing apparatus comprising:

(a) closed-loop means through which an input signal circulates while being delayed, wherein a delay time which is obtained when said input signal circulates through said closed-loop means once is set identical to a reciprocation period which corresponds to when the sound vibration is transmitted forward and backward through the sound-generation system;

(b) excitation means for generating an excitation signal corresponding to the sound vibrator, said excitation means generating said excitation signal based upon an operation parameter supplied thereto, and said excitation signal being supplied to said closed-loop means;

(c) tone pitch information generating means for generating tone pitch information; and (d) scaling coefficient generating means for generating a scaling coefficient based on said tone pitch information, said scaling coefficient being used to very said operation parameter for said excitation means.

2. A musical tone synthesizing apparatus according to claim 1 wherein the excitation means generates said excitation signal based upon an operation parameter supplied thereto by use of a non-linear function which is determined based on a relationship between a relative displacement and a resiliency characteristic of said sound vibrator and sound-generation system of the natural musical instrument to be simulated.

3. A musical tone synthesizing apparatus according to claim 1, wherein said scaling coefficient generating means generates said scaling coefficient, representing an influence rate corresponding to an influence to be applied to said sound vibrator by said sound-generation system.

4. A musical tone synthesizing apparatus according to claim 1, wherein the natural musical instrument is a piano so that said sound vibrator is a hammer and said sound-generation system is a string to be struck by said hammer.

5. A musical tone synthesizing apparatus comprising:

(a) pitch information generating means for generating pitch information corresponding to a musical tone to be synthesized;

(b) closed-loop means through which an input signal circulates while being delayed, wherein a delay time which is required when said input signal circulates through said closed-loop means once is set according to said pitch information;

(c) excitation signal generating means for generating an excitation signal which is supplied to said closed-loop means as said input signal in order to form a musical tone signal in said closed-loop means; and (d) scaling means for varying said excitation signal in accordance with said pitch information.

6. A musical tone synthesizing apparatus according to claim 5, wherein said excitation signal generating means comprises:

initial signal generating means for generating a initial signal; and non-linear conversion means for converting said initial signal according to a non-linear function in order to form said excitation signal.

7. A musical tone synthesizing apparatus according to claim 6, wherein said excitation signal is fed back to said initial signal generating means, wherein a level of said fed back signal is varied by said scaling means in accordance with said pitch information.

8. A musical tone synthesizing apparatus according to claim 7, wherein said excitation signal which is fed back to said initial signal generating means is integrated and then multiplied by a coefficient which is varied by said scaling means in accordance with said pitch information, which result is subtracted from or added to said initial signal.

9. A musical tone synthesizing apparatus according to claim 6, wherein said excitation signal which circulates through said closed-loop means is fed back to said non-linear conversion means, wherein a level of said fed back signal is varied by said scaling means in accordance with said pitch information.

10. A musical tone synthesizing apparatus according to claim 9, wherein said excitation signal which is fed back to said non-linear conversion means is integrated and multiplied by a coefficient which is varied by said scaling means in accordance with said pitch information, which result is further subtracted from or added to an integration result of said initial signal.

11. A musical tone synthesizing apparatus according to claim 6, wherein said excitation signal is fed back to said non-linear conversion means, and a level of said excitation signal which is fed back to said non-linear conversion means is varied by said scaling means in accordance with said pitch information.

12. A musical tone synthesizing apparatus according to claim 11, wherein said excitation signal which is fed back to said non-linear conversion means is integrated and multiplied by a coefficient which is varied by said scaling means in accordance with said pitch information, which result is subtracted from or added to an integral result of said initial signal.

13. A musical tone synthesizing apparatus according to claim 6, wherein multiplication means is provided in a prior stage of said non-linear conversion means where said initial signal is multiplied by a coefficient which is varied by said scaling means in accordance with said pitch information.

14. A musical tone synthesizing apparatus according to claim 13, wherein said coefficient is set at a relatively large value when said pitch information indicates relatively high pitch, while said coefficient is set at a relatively small value when said pitch information indicates relatively low pitch.

15. A musical tone synthesizing apparatus according to claim 6, wherein said non-linear function is varied in accordance with said pitch information.

16. A musical tone synthesizing apparatus according to claim 15, wherein rise-up inclination of said non-linear function is set relatively large when said pitch information indicates relatively high pitch, while rise-up inclination of said non-linear function is set relatively small when said pitch information indicates relatively low pitch.

17. A musical tone synthesizing apparatus according to claim 5, wherein said excitation signal generating means includes multiplying means for varying said excitation signal, further said scaling means providing said multiplying means with a coefficient, said coefficient is varied in accordance with said pitch information.

18. A musical tone synthesizing apparatus according to claim 17, wherein said scaling means further comprises table means which stores plural coefficients, where said scaling means read outs one of said plural coefficients corresponding to said pitch information.

* * * * *